US008591213B2

(12) United States Patent
Fare'

(10) Patent No.: US 8,591,213 B2
(45) Date of Patent: Nov. 26, 2013

(54) APPARATUS AND PROCESS FOR THE PRODUCTION OF A NON-WOVEN FABRIC

(75) Inventor: Rosaldo Fare', Fagnano Olona (IT)

(73) Assignee: FARE' S.p.A (IT)

( * ) Notice: Subject to any disclaimer, the term of this patent is extended or adjusted under 35 U.S.C. 154(b) by 846 days.

(21) Appl. No.: 12/516,060

(22) PCT Filed: Dec. 17, 2007

(86) PCT No.: PCT/IB2007/003944

§ 371 (c)(1),
(2), (4) Date: Jun. 25, 2009

(87) PCT Pub. No.: WO2008/075176

PCT Pub. Date: Jun. 26, 2008

(65) Prior Publication Data

US 2010/0062672 A1 Mar. 11, 2010

(30) Foreign Application Priority Data

Dec. 15, 2006 (EP) ..... 06425840

(51) Int. Cl.
*D01D 5/098* (2006.01)
*D04H 3/16* (2006.01)

(52) U.S. Cl.
USPC ..... 425/72.2; 425/66; 425/83.1

(58) Field of Classification Search
USPC ..... 425/66, 72.2, 83.1
See application file for complete search history.

(56) References Cited

U.S. PATENT DOCUMENTS

| | | | | |
|---|---|---|---|---|
| 4,812,112 | A | 3/1989 | Balk | |
| 4,813,864 | A | 3/1989 | Balk | |
| 4,820,142 | A | 4/1989 | Balk | |
| 5,439,364 | A * | 8/1995 | Gerking et al. | 425/66 |
| 5,766,646 | A | 6/1998 | Geus et al. | |
| 5,814,349 | A | 9/1998 | Geus et al. | |
| 5,820,888 | A | 10/1998 | Geus et al. | |
| 5,968,557 | A | 10/1999 | Weger et al. | |
| 6,277,320 | B1 * | 8/2001 | Pai et al. | 264/465 |
| 2001/0054783 | A1 | 12/2001 | Kobayashi et al. | |
| 2002/0020047 | A1 | 2/2002 | Yoshida | |
| 2002/0102897 | A1 | 8/2002 | Berrigan | |
| 2002/0155185 | A1 | 10/2002 | Tange et al. | |
| 2003/0147982 | A1 | 8/2003 | Allen | |
| 2003/0161904 | A1 | 8/2003 | Geus et al. | |
| 2003/0178742 | A1 * | 9/2003 | Geus et al. | 264/211.22 |
| 2004/0009251 | A1 | 1/2004 | Becker et al. | |
| 2006/0040008 | A1 | 2/2006 | Geus et al. | |
| 2007/0090555 | A1 | 4/2007 | Roettger et al. | |
| 2007/0134478 | A1 | 6/2007 | Haberer et al. | |

FOREIGN PATENT DOCUMENTS

| | | | |
|---|---|---|---|
| DE | 4014413 | A1 | 11/1991 |
| DE | 4014414 | A1 | 11/1991 |
| DE | 29518813 | U1 | 1/1996 |
| EP | 1079012 | A | 2/2001 |
| EP | 1340844 | A | 9/2003 |
| EP | 1630265 | A | 3/2006 |
| WO | WO 2005061773 | A1 * | 7/2005 |

* cited by examiner

*Primary Examiner* — Yogendra Gupta
*Assistant Examiner* — Joseph Leyson
(74) *Attorney, Agent, or Firm* — Hess Patent Law Firm LLC; Robert J. Hess

(57) ABSTRACT

In an apparatus for the production of a non-woven fabric of filaments, where a plurality of filaments are extruded, cooled, stretched and collected on a mobile support, the means of collecting the filaments include furthermore, a gas permeable mobile support element (28), an aspirator (29) and one or more aspiration ducts (33C-36C), the collecting means being insulated from the environment air.

7 Claims, 10 Drawing Sheets

APPARATUS AND PROCESS FOR THE PRODUCTION OF A NON-WOVEN FABRIC

FIELD OF THE INVENTION

The present invention relates to an apparatus and a process for the production of a non-woven fabric; in particular, the invention relates to a process and an apparatus for the production of yarns stretched in a current of air (i.e. by aerodynamics) and formed into a layer of non-woven fabric (webs).

BACKGROUND OF THE INVENTION

A typical apparatus for the production of spunbond yarn includes a spinneret fed by extruders, a cooling chamber where the filaments undergo a first partial cooling, a stretching unit and a deposition unit to deposit the stretched filaments onto a mobile support where the desired non-woven fabric is formed. The mobile support is generally an air permeable belt onto which the filaments are deposited and retained by air blown by special means; downstream of the point of deposition of the filaments on the belt there is a pair of rollers to calender the layer of deposited filaments.

All these modules (extrusion, cooling, stretching and depositing) are very important to achieve a good final product.

Among these modules, particular importance have the stretching area and that of deposition of the filaments on the mobile support. In fact, the count of the filament depends on the extent of the stretching of the same filament and such stretching is also controlled by the stretching airflows in the stretching area and area of deposition of the stretched filament.

The patent application US 2003/0178742, in the name of Reifenhauser, describes an apparatus in which the cooling area is connected to the stretching area without an opening for the supply of air. The stretching area is provided with two diffusers, each of which has a section reduction to produce a Venturi effect and therefore an acceleration of the air. Between the first and second diffuser there is an inlet for secondary air that is the only inlet other than that for the cooling air in the cooling chamber. The area of suction includes three regions of aspiration located in succession in the area of deposition of the stretched filaments on the collecting belt; such areas are provided with distinct means of aspiration for each region or, alternatively, a single aspiration fan connected to the three areas through ducts and valves.

Patent application US 2003/0161904, in the name of Reifenhauser, describes a system for depositing filaments on a mobile collecting belt by aspiration, according to which there are at least two aspiration areas under the mobile collecting belt controlled independently of each other, one such area being the principal, located corresponding to the area of greatest deposit of the filaments. The speed of aspiration in the principal area is significantly higher than that of the other aspiration areas (second and third area of aspiration).

EP-A-1630265 discloses an apparatus for the continuous production of a nonwoven web from filaments made from two thermoplastic synthetic materials (FIGS. 5 and 6), i.e. multicomponent filaments. The apparatus comprises a spinning nozzle, a cooling chamber, a stretching unit and a collecting device for depositing filaments onto the nonwoven web. The cooling chamber is divided into two or more cooling chamber sections to supply filaments with process air at different temperatures. The collecting device comprises a mobile belt, which is gas permeable, at least one aspirator and a plurality of suction ducts (referred to as 18, 19 and 20 in FIG. 4) to define a plurality of suction areas on the mobile belt. The suction ducts have different sections to provide different suction forces on the belt. The embodiments discussed above and in general those of the state of the art don't allow the desired uniformity of fiber density to be achieved or maintained along the whole layer of deposited filaments. Excessive variation in the deposition of filaments on the collecting belt translates into a finished fabric whose mechanical characteristics vary from area to area of the same belt, something obviously to be avoided.

EP-A-1630265 teaches the suction force to be adjusted locally by controlling the air speed in each suction duct located under the collecting belt, with the aim of compensating uneven deposition of the filaments falling on the belt. This solution still does not avoid uneven deposition of the filaments on the moving belt, and this may cause the non-woven fabric to be formed with random non-uniform portions.

A further problem is the necessity to increase the speed of the mobile support, i.e. the belt, without jeopardizing the uniformity of deposition of the filaments and therefore the composition of the non-woven fabric.

It is an aim of the present invention to solve the aforementioned problems and to provide an apparatus and a process for the production of nonwoven fabrics having uniform filament distribution at higher speed that it is now possible.

SUMMARY OF THE INVENTION

This aim is achieved by the present invention that relates to an apparatus for the continuous production of a non-woven fabric of filaments comprising means of extrusion, cooling, stretching and collecting the filaments.

The invention relates, furthermore, to a process for the production of non-woven fabrics through extrusion of a plurality of filaments, cooling of said filaments, stretching same filaments and depositing them on a mobile support in the form of non-woven fabric.

A further object of the invention are fibers produced by co-extrusion of two or more polymers and in particular fibers of two or more incompatible polymers for later "splitting" treatment.

As will be discussed in more detail in the following description, the process provides for the extrusion of a plurality of filaments from a spinneret, cooling said filaments in a cooling chamber, stretching said filaments in a stretching duct located below the cooling chamber, depositing the stretched filaments on a mobile support to form a layer of filaments, and drawing air through said belt in correspondence to a plurality of aspiration areas defined by corresponding suction ducts in a deposition area that is substantially insulated from ambient air.

Advantageously, the aspiration (or suction) ducts on the one hand have different extension and section to operate with different speeds of aspiration in different areas of the belt while the collecting device, which comprises the portion of the mobile support onto which filaments are deposited, is substantially insulated from environment air. In this respect the apparatus of the present invention is provided with means for pneumatically insulating the deposition area from external environment. Preferably, such insulating means comprises a dedicated protective shell or a containment case and a plurality of cylinders, namely pressing cylinders. The ducts are arranged below the mobile support, which is gas permeable, with the ducts operating at highest speeds of aspiration/suction at the centre, in correspondence of the filaments deposition area, and the ducts operating at lowest speeds of aspiration/suction on both the sides of the mobile support from the centre, also externally to the cylinders. In one embodiment ducts operating at mean or intermediate speeds of aspiration/suction are provided in between.

The present invention provides independent control over the suction force applied onto the mobile support, i.e. the collecting belt, so as to create higher depression in correspondence of the area of maximum deposition of the filaments, and lower depression next to the pressing and/or calender cylinders. The collecting device is kept substantially insulated from the environment, by means of a protective shell which acts as a pneumatic barrier. With the wording "pneumatic insulating means" or "insulation means" it is meant means arranged in a configuration that determines minimum disturbance of the airflows generated inside the protective case (or shell) by the moving filaments and moving belt. In other words, the airflows inside the protective shell are not affected by the external air currents or turbulence which, in traditional apparatuses, cause uneven distribution of the filaments depositing on the moving belt and, in some cases, the layer of filaments to detach from the belt. In this respect, the pressure gradient generated along the belt by ducts operating at different speeds aspiration/suction promotes flowing of the air inside the shell toward the centre of the mobile belt, with uniform airflows which are less turbulent than in prior art systems, where the belt is exposed to the atmosphere or environment.

On the other hand, each duct may be divided by diaphragms into a plurality of channels with the purpose of regulating the airflow in said channels to have equal aspiration speed in all the channels along the whole extension of the duct. This feature is disclosed in greater detail in the pending European patent application n. EP 06425840 of which priority is claimed.

According to a preferential aspect of the invention, the filaments are accelerated and stretched by making them pass through two Venturi effect elements.

According to a further aspect of the invention, the stretched filaments are made to pass through a distributing element (or disorganizer) before being deposited on a collector belt, which constitutes the mobile support, to obtain a random but uniform deposition of the filaments.

According to a further aspect of the invention, the entire area of deposition of the filaments on the belt is held under reduced pressure, with different values from area to area in longitudinal direction and equal values in the direction transversal to the conveyor belt.

According to an aspect of the present invention, the collecting means that are arranged under the stretching duct, are provided with a protective shell or case which encompasses the calender cylinders and a length of the moving belt so as to minimize the air inflow from the external environment. Preferably there is provided a first couple of pressing cylinders, which press the collecting belt downstream of the filaments deposition area, and at least one, preferably a second couple of opposed cylinders, located upstream of said deposition area for permitting the collecting belt to enter the protective shell or case, thereby acting as a sort of "rotating door" of the containment case.

It was found that the process and the apparatus according to the present invention allow result in a very uniform deposition of the filaments and in the possibility to increase the speed of production of at least 10% and up to 20-25% with respect to known techniques.

BRIEF DESCRIPTION OF THE DRAWINGS

The invention will now be described in more detail with reference to the attached drawings, which are by way of illustration and not limiting, where.

DETAILED DESCRIPTION OF THE INVENTION

Figure 1:
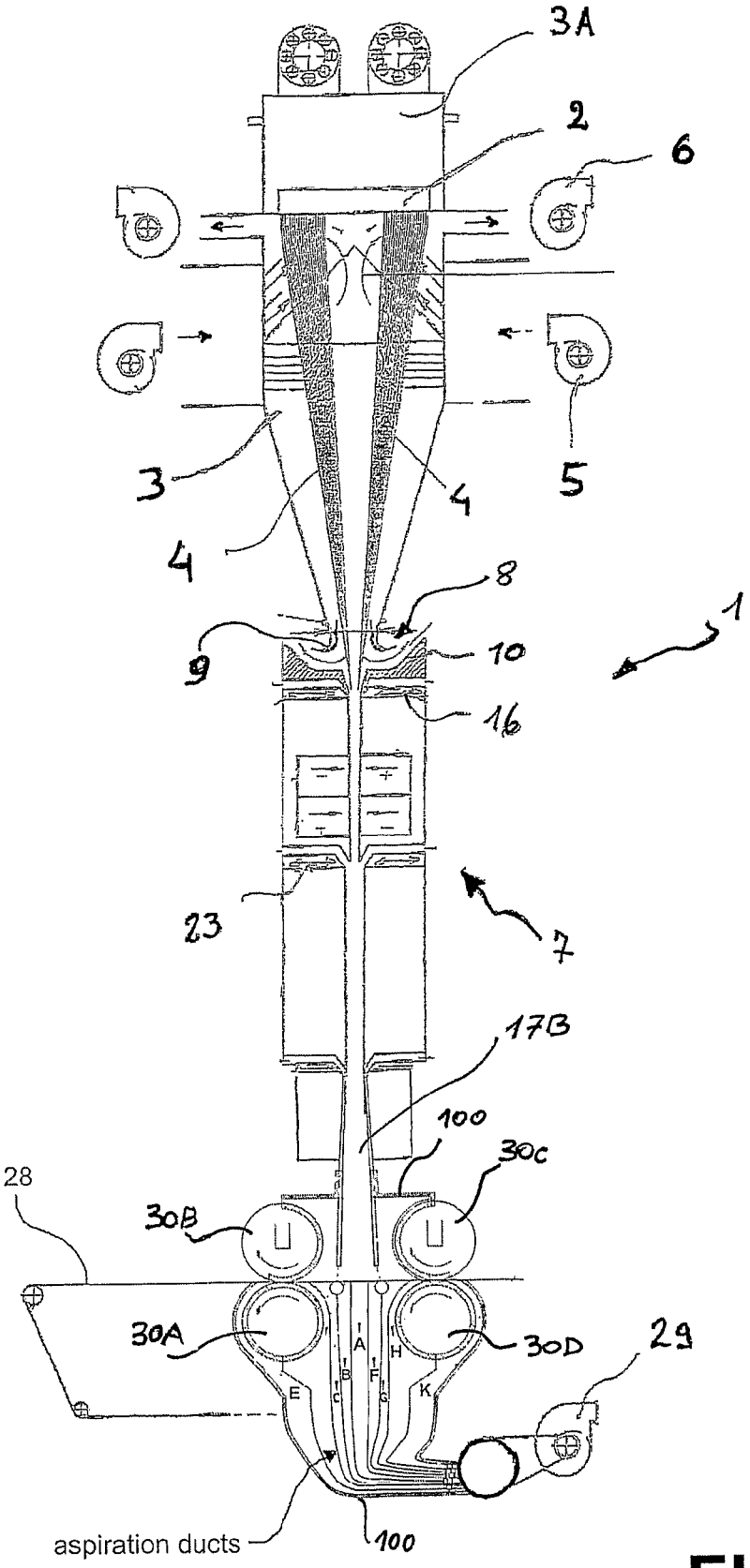
FIG. 1 is a schematic side view of the apparatus according to the present invention.

With reference to FIG. 1, the apparatus 1 for the production of a non-woven fabric of filaments according to the present invention comprises an extrusion head 3A, comprising a spinneret 2 to extrude a plurality of filaments, to which are connected one or more extruders (not shown) for the extrusion or the co-extrusion of mono, bi or tri-component filaments, as already known in the art and as described and claimed in, for instance, the European patent applications EP-A-00112329.8 and EP-A-96830305.7, both in the name of Farè S.p.A.

Figure 15:
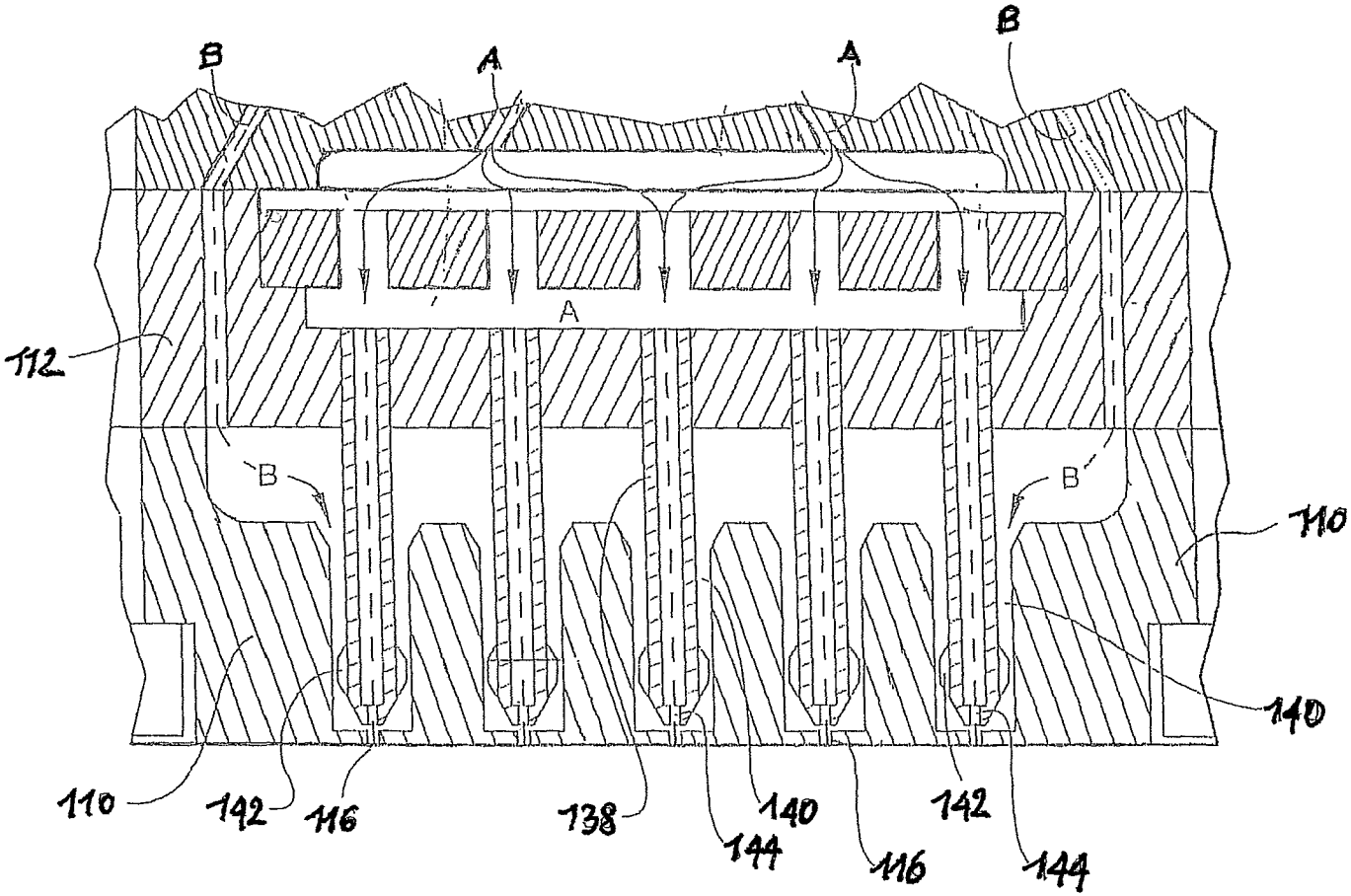
FIG. 15 is a schematic view in section of an extrusion head suited for use with the device according to the present invention.

The extrusion head and the spinneret 2 are preferably produced as described in the European patent n. EP 0995822 and in the U.S. Pat. No. 6,168,409 in the name of Farè S.p.A.; in these patents (here included by reference) an extrusion device is described that is particularly suited for the production of spunbond yarn using two or more polymers like those disclosed here. The device of EP 0995822, shown in FIG. 15 of the present application, comprises a first spinneret of extrusion 110 provided with a plurality of ducts 140 and extrusion holes 116 for a polymer B and of a second spinneret 112 having a second plurality of extrusion holes 144 and ducts 138 of a polymer A, in which the holes and the ducts of extrusion are co-axial and aligned to give between them the required co-extruded structure for the filament. From the spinneret 112, set upstream (in relation to the flow of the polymers) of the first spinneret 110, the extrusion ducts 138 extend into the ducts 140 of the first spinneret 110 until they are close to the extrusion holes 116, i.e. in proximity of the nozzles 116 from which two (or more) polymers are extruded.

The extrusion ducts of the second spinneret 112 are made of a material, generally steel, that is sufficiently flexible to allow the necessary movement to compensate for the different thermal expansions to which the two spinnerets 110 and 112 are subjected during operation because of the different temperatures of extrusion of the polymers A and B. Furthermore, there are means of maintaining the flexible steel ducts 138 aligned and co-axial with the ducts of the spinneret in which there are lodged; such means include, for instance, some fins or projections 142 made on the terminal portion of the flexible duct.

Due to the spinneret structure described above, it is possible to provide very wide co-extrusion spinnerets, i.e. a six meter wide single spinneret, which was not possible with traditional spinnerets.

With reference to FIG. 1, in the cooling chamber 3 are visible two bundles of filaments 4, as described in the pending European patent application EP 06425841.1 in the name of the present applicant. It is obviously understood that the present invention can also be used with other means of cooling the extruded polymers, such as, for instance, the double chamber shown in the patents mentioned above or other known systems.

If the cooling chamber 3 is used to circulate air according to said European patent application EP 06425841.1, such chamber provides for the presence of blowers 5 and aspirators 6 to create the required airflows.

At the lower extremity of the chamber 3, where the bundles of filaments 4 are gathered and introduced into the pneumatic stretching duct 7, there is an area of pressure equilibrium 8, that comprises oscillating elements 9 that interact with an airflow deflector 10. Such area of pressure equilibrium 8 is visible in FIGS. 1 to 3. According to an aspect of the present invention, the stretching channel 7 has different speeds in its various components. Such components comprise at least two Venturi-effect elements to accelerate the airflow that pulls the filaments and a distributing element or disorganizer, to randomise the position of the filaments and to give uniform deposition on the collecting belt 28 below all the apparatus.

Figure 2:
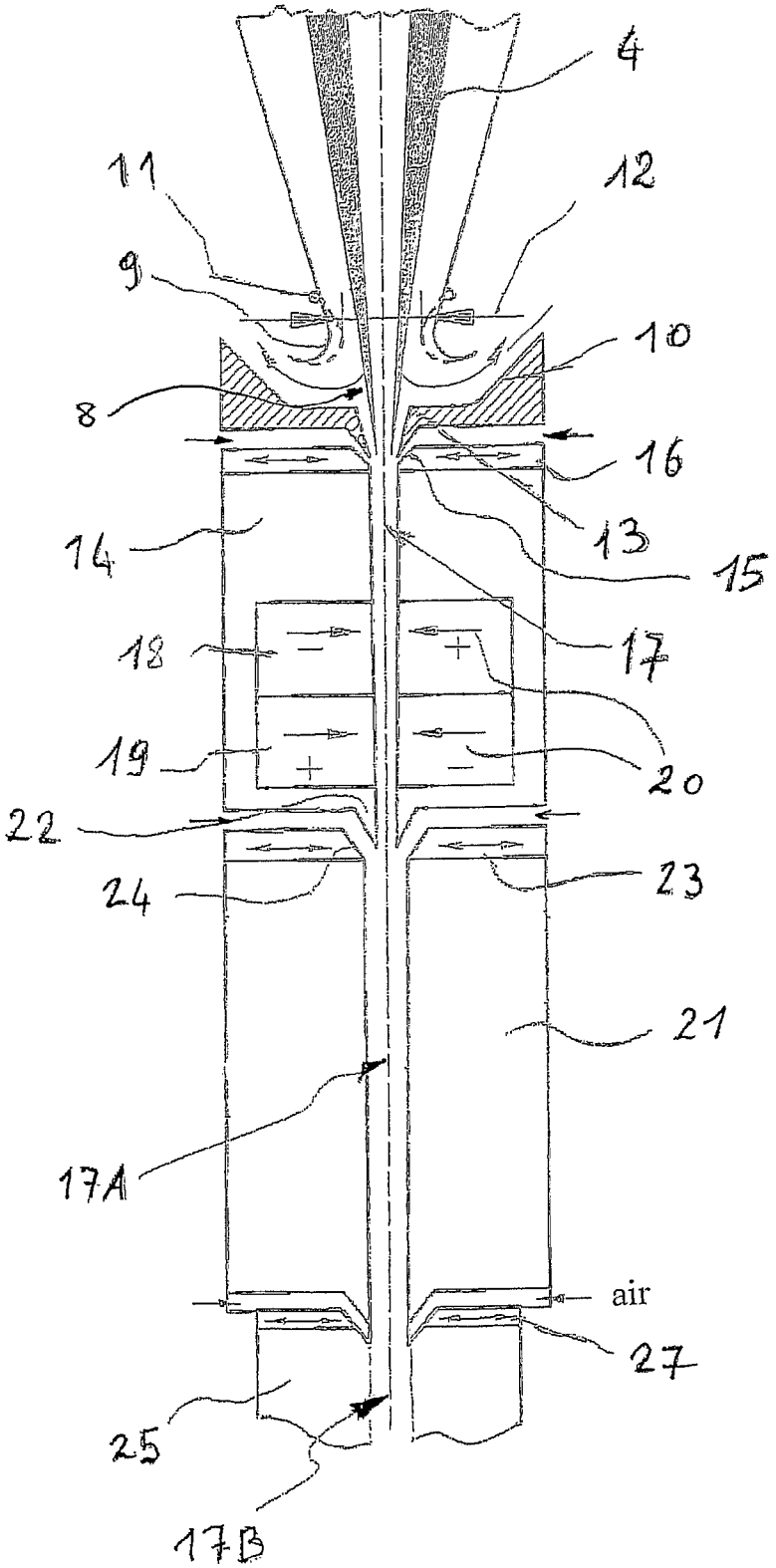
FIG. 2 is a magnified view of the stretching area of the apparatus of FIG. 1.
Figure 3:
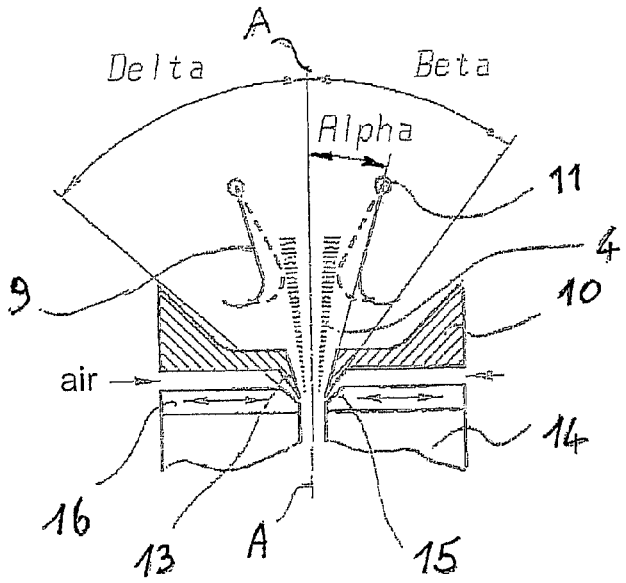
FIGS. 3-5 are magnified views of the geometries of the three entries of air to the stretching channel according to the present invention.

FIGS. 2 and 3 show the structure of the flow regulation complex at the exit from chamber 3: a part of the cooling airflow escapes into the ambient atmosphere and a part is pulled into the stretching duct 7. As mentioned above, there are curved and oscillating elements 9 hinged on 11 on the extremity of the chamber 3. The position, or angle, of the oscillating portions 9 is controlled by actuators 12 (FIG. 2); the oscillating elements 9 are provided with a plain portion and of an extremity curved toward the outside.

As best shown in FIG. 3, the oscillating elements interact with the flow deflector 10, which presents a conic portion 13 centrally, tapered toward the mouth of the duct of the first Venturi element 14. The planes corresponding to the internal and external walls of the said conic portion 13 form angles Alpha and Beta with the axis A-A; the range of the angle Alpha corresponds to that of the angle of entry of the filaments 4. The value of the angle Alpha is from 3 to 25 degrees, preferably between 9 and 15 degrees and more preferably 12 degrees. The angle Beta is between 12 and 35 degrees, preferably 20 to 24 degrees and more preferably 22 degrees.

The entry of the stretching duct has a tapered portion with walls 15 inclined toward the conic portion 13 of the deflector 9 and forming an angle Delta with the axis A-A of the duct, ranging between 12 and 35 degrees, preferably between 18 and 22 degrees and more preferably of 20 degrees. The tapered walls 15 of the duct belong to the entry of the Venturi element 14 and are horizontally mobile (as indicated by the arrows) thus forming a flow rate regulator 16 by varying the distance between the walls 15 and the external walls of the flow deflector 10. The minimum distance between the walls in the duct is between 15 and 30 mm and preferably between 20 and 24 mm. The structure described above thus forms a Venturi system able to produce an entry of air to the duct 17 with adjustable speed generally between 30 and 45 m/s inclusive.

Figure 4:
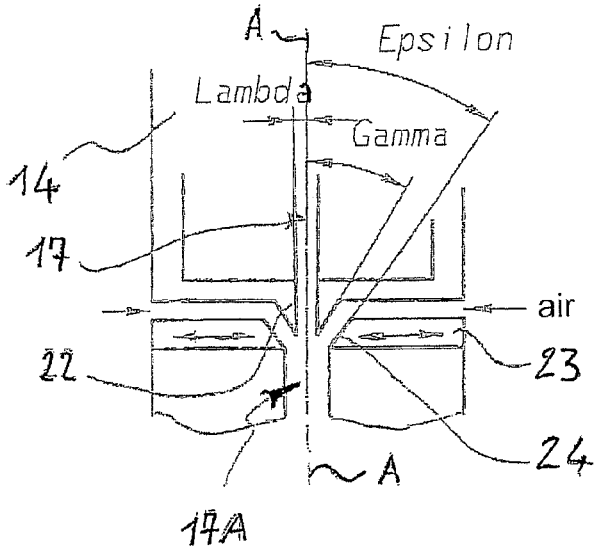

The portion 17 of the stretching duct corresponding to the first Venturi element 14 constitutes an acceleration channel having convergent walls with an angle Lambda between 0.5 and 4 degrees, preferably 2 degrees (FIG. 4).

Before the end of the duct 17 there is a filament ionisation chamber 18 and a filament de-ionisation chamber 19. The purpose of ionizing the filaments is to eliminate any possible electrostatic charges and so to avoid attraction or union between single filaments or bundles of filaments.

It is therefore important that the ionization field, even though not very high, is constant over time. During the phase of ionising and de-ionising the filaments, the chambers 18 and 19 accumulate dusts and oligomers that would make the treatment device useless in a short time. To avoid such problems and in addition to the possibility of manually cleaning the chamber 18, the apparatus according to the present invention includes a plurality of jet blowers and aspirators, shown in schematic way by the arrows 20, that allow the deposits to be removed in a constant and continuous way without the need to intervene manually and without interrupting the spinning. Cleaning is programmed and automatic, leaving the ionising field operative.

Below the first Venturi element 14 there is a second Venturi element 21 whose entry has geometry similar to that discussed above. In more detail, there is a tapered terminal portion 22 of the duct 17 where, as shown in FIG. 4, the angle Gamma formed by the external wall of the portion 22 with the axis A-A (the internal portion angle is Lambda described above) is between 15 and 40 degrees, preferably between 18 and 25 degrees and more preferably 20 degrees.

As for the first Venturi, there are the flow regulators 23 comprising horizontally mobile blocks to vary the distance between their tilted wall 24 and the external wall of the extremity 22 of the element 14. The angle Epsilon formed by the wall 24 with the axis A-A is between 10 and 35 degrees and is preferably 25 degrees.

The speed of the air entering the two portions 17 and 17A of the stretching duct is similar at the two entries and is regulated by the regulators 16 and 23 to a value of 35-40 m/s, preferably of 38 m/s.

The duct 17A is slightly divergent, with an angle Sigma (FIG. 5) between 0.5 and 5 degrees, preferably of 2.5 degrees, and the minimum distance between the walls in the duct 17A is between 18 and 40 mm, preferably 30 mm.

Figure 5:
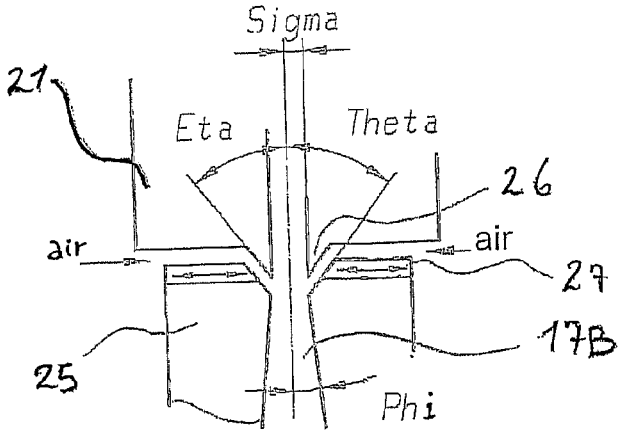

The last module of the stretching channel 7 is formed by a distributor element 25, that comprises a channel of disorganisation, or of distribution, of the filaments 4. The entry to this channel is shown in FIG. 2 and FIG. 5. As it can be seen, the walls of the distributing channel 17B are also divergent and they form an angle Phi with the axis A-A, of between 3° and 10°, preferably 7°. The minimum distance of the walls in channel 17B is between 30 and 80 mm, preferably 50 mm.

The air enters the distributing channel 17B in a similar way to air entering element 21. A tapered portion 26 has an external face tilted at an angle Eta to the axis A-A; the angle is between 10° and 30°, preferably 20°-21°. The flow regulator 27 has an external face tilted at an angle Theta to the axis A-A; the angle is between 10° and 35° degrees, preferably 20°-25° and more preferably 23°. The channel 17B is the last portion of the stretching duct and extends until the belt 28 that is described below in more detail together with the aspirator 29 connected pneumatically to it. The stretching duct 7 operates as follows:

Aspirator 29 produces a low pressure area that draws atmospheric air through the entries between the oscillating elements 9 and deflector 10, between deflector 10 and flow regulators 16, between first Venturi 14 and flow regulators 23 and between second Venturi 21 and flow regulators 27 of distributing element 25. In the upper portion of the channel, corresponding to the deflector 10, the airflows entering channel 17 are mixed with the airflow arriving from the cooling chamber. The air is accelerated by the succession of Venturi-effect elements described, increasing the speed of the filaments being drawn along in the channels. The flow regulators 16 and 23 allow the quantity of atmospheric air necessary to accelerate the airflow to be introduced, while the flow regulator 27, provided on the distribution channel, controls the flow rate and speed of the atmospheric air that cooperates in the distribution of filaments.

After being passed into the stretching channel 7, the filaments are deposited on a mobile support generally formed by a conveyor belt 28; the conveyor belt 28 has a permeability sufficiently high to allow an effective reduction in pressure (suction) of the air drawn through it and at the same time not so permeable as to allow any fibers to pass through into the aspiration chamber below.

Figure 6:
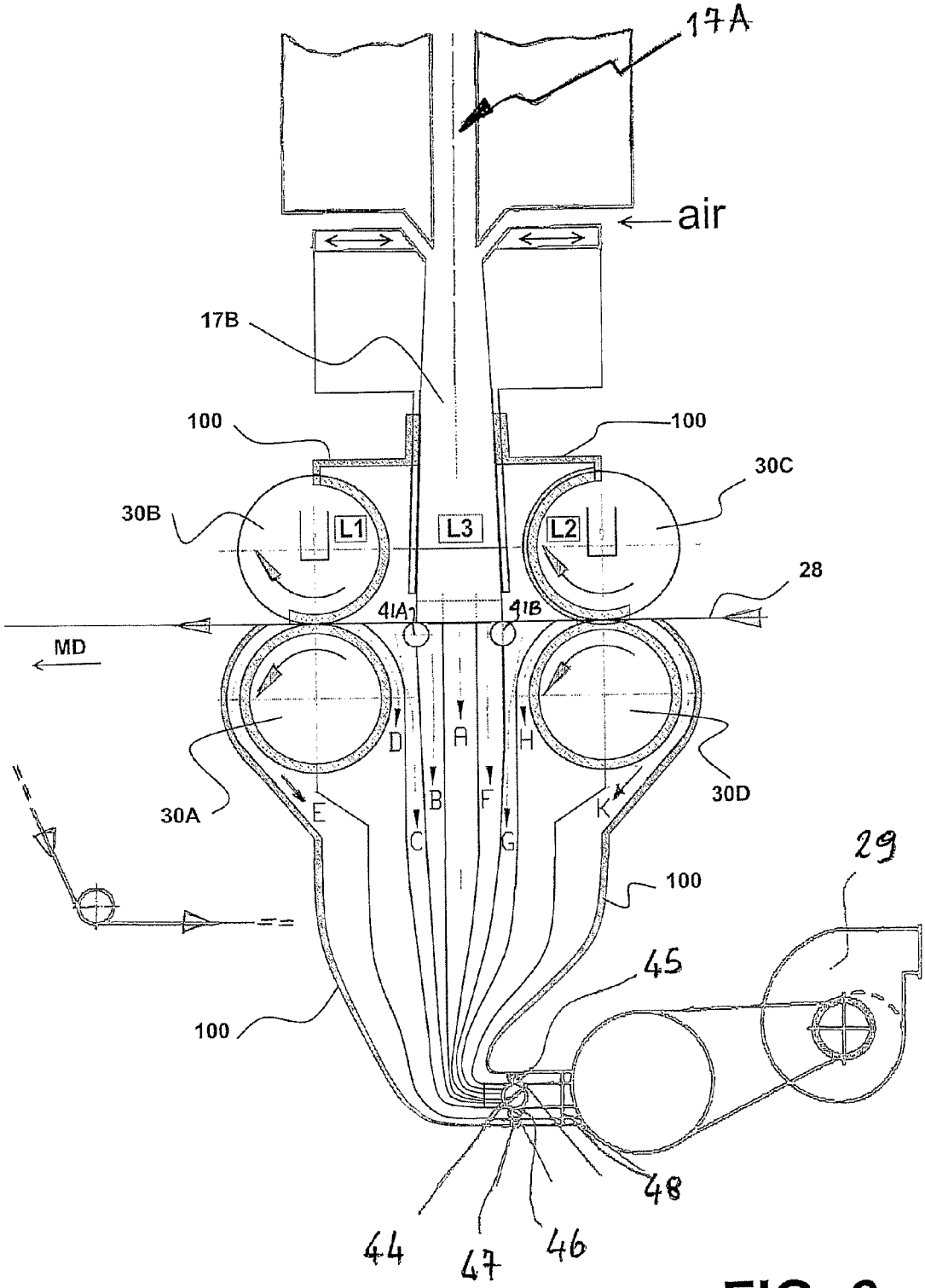
FIG. 6 is a view of the area of deposition of the filaments on a conveyor belt exiting the cooling chamber according to the invention.
Figure 7:
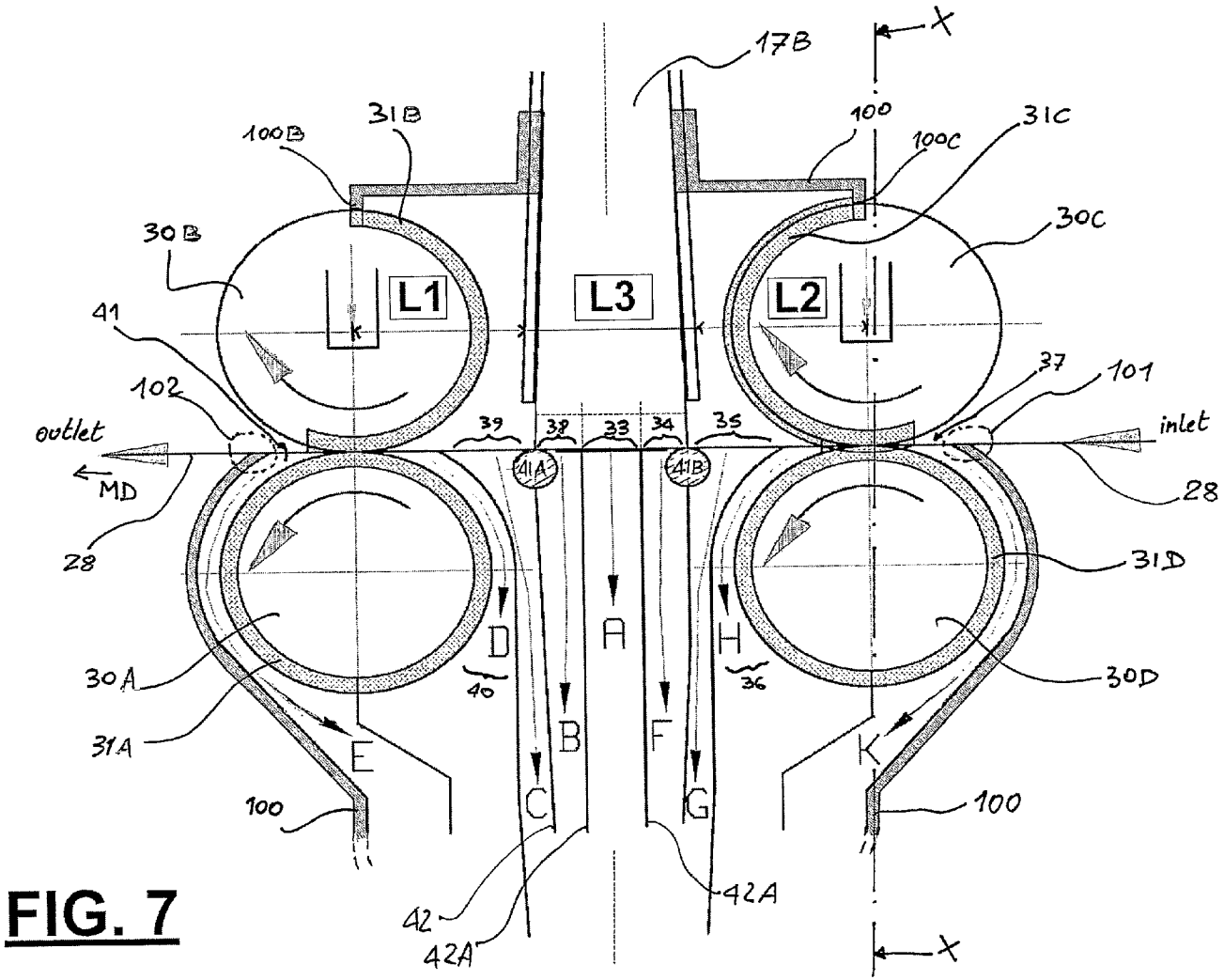
FIG. 7 is a magnified view of FIG. 6.
Figure 7A:
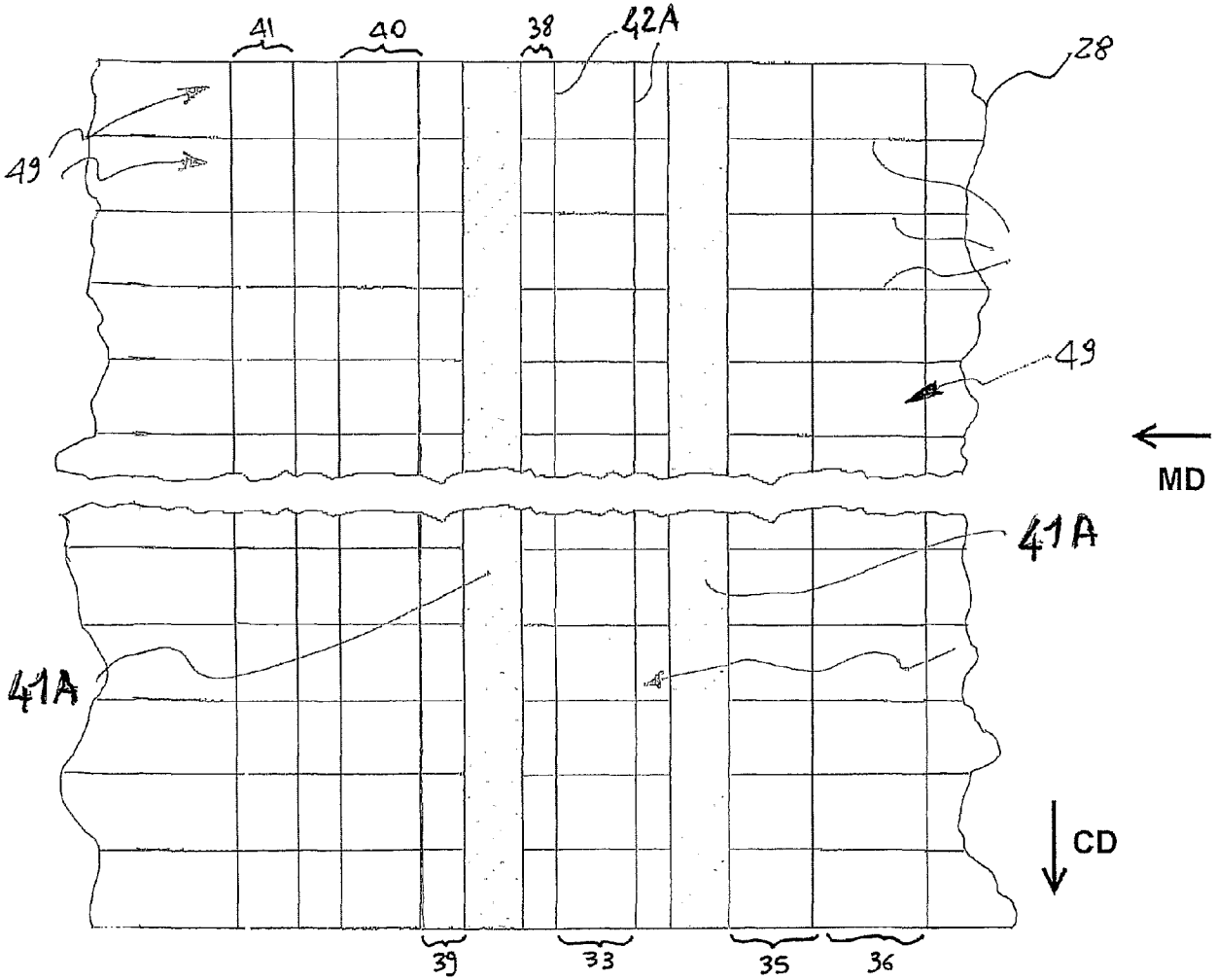
FIG. 7A is a plan view of the structure of aspiration under the conveyor belt.

The filaments leaving the distributing channel are deposited on belt 28 at a filament deposition area 33 under the exit of channel 17B; area 33 is part of an area of formation of the non-woven fabric that also extends upstream and downstream of the area of deposition 33 (FIGS. 6-7A).

The filaments are deposited on the belt 28 in a random way (disorganized) and this results substantially in a disorganised distribution but with uniform filament density. In order to avoid atmospheric or environment air from disturbing deposition of the filaments 4, a barrier is provided in the form of a containment case or shell 100. The containment case or shell 100 is shown in FIG. 1 in its entirety, while details are visible in FIGS. 6 and 7. The walls of the containment case 100 are shown in FIG. 7 with diagonal upward lines filling.

The containment case or shell 100 preferably in combination with the cylinders provided at the two ends of the deposition area and with the external suction ducts E and K, substantially insulates a length of the belt 28, the respective aspiration ducts (below the belt) and the exits from the channel 17B from environment. In other words, the deposition area is confined in a case 100 which minimizes inflow of air from the outside of the same case 100, thereby minimizing or preventing any disturbance of the (vectorial) velocity field of the airflows generated on and around the deposition area by the movement of the filaments 4, the air drawn through the channel 17B and by the movement of the belt 28.

In this respect, the airflows inside the containment case, or barrier, 100 are as much uniform as possible, and more than all are constant in time, i.e. they are not affected during operation of the apparatus 1 by external air currents. This configuration allows for maintaining stable in time the production of high quality non-woven web.

Moreover, this configuration allows for an unexpected increase in the output of the apparatus. The speed of production can be doubled with respect to known apparatuses provided with traditional spinnerets and collecting device. The speed of production can be improved of about 20% with respect to apparatuses provided with the spinneret described above with reference to FIG. 15 and traditional collecting device.

As best shown in FIG. 1 and FIG. 7, the containment case or shell 100 provides walls on the upper portion of the deposition area 33; such walls are sealed against the walls of the exit of the channel 17B and partially enclose the pressing cylinder 30B on one side, downstream of the deposition area 33, and another cylinder 30C on the opposite side, upstream of the same area 33. On its lower portion, the case 100 provides walls which abut on the lower surface of the belt 28 and which converge into a flow regulator system 44 of the aspirator 29.

At this stage, the non-woven fabric has not yet been subjected to a filament-linking process, for instance by thermo-welding, needle-pointing or jet bonding with water and it needs a treatment that compacts the filaments enough to make them able to subject them to the later linking treatments.

For this purpose, the layer of filaments is calendered between the two pressing cylinders 30A-30B to bind the non-woven fabric. The upper cylinder 30B is provided with means of heating it to a temperature between 50° and 140 C.° inclusive, generally around 90° C. and however chosen on the basis of the polymers used and such to achieve an initial cohesion of the filaments.

The pneumatic seal between the calender cylinders 30A and 30B and the containment case 100 is obtained through a mobile diaphragm or front and side seals. In particular, the cylinder 30B is provided with a front seal 100B and a side seal 31B, the cylinder 30A is provided with the side seal 31A only. The front seal 100B follows the movement of the pressure roller 30B as it works against the lower rubberised cylinder 30A. In the shown embodiment, seals 31A, 100B, and 31B are manufactured as laminated metal sheets arranged with an edge as much close as possible to the respective cylinder external surface; alternatively they can be blocks of low-friction materials, for instance Teflon, arranged to abut the cylinder surface without appreciably affecting its rolling. Alternatively the seals 31A, 100B, and 31B may be metal foils covered with a low-friction material and arranged to abut the respective cylinder with an edge or to be located as much close as possible to the cylinder external surface. The seals 31A, 100B, and 31B may also be manufactured as elements having complementary shape with respect to the external surface of the cylinder, so as to create a labyrinth for limiting at the minimum the passage of ambient air into the suction area.

According to another embodiment of the present invention, the seals can be felt stripes arranged onto the case 100 walls to slide over the cylinders.

The seal 100B shown in FIG. 7 almost abuts the external surface of the cylinder 30B, along its length. The gap between the seal 100B and the external surface of the cylinder 30B is within the range 2-5 mm.

The side seals 31B and 31A are for avoiding the air form entering the case 100 in correspondence of the cylinders bases.

The cylinders 30A and 30B are operated at the same speed as the forming belt 28, that passes between them with the filaments deposited on it at the end of the channel 17B.

Due to the presence of the seals 31A, 100B, and 31B, the cylinders 30A and 30B act as "rotating doors" for the belt 28 exiting the insulated case 100.

On the opposite side there is a second couple of cylinders 30C and 30D located at the entry of the chamber 100 with the function of closing the same and sealing the area of filament deposition and formation of the layer of non-woven fabric. These cylinders may be identical to the calender cylinders 30A and 30B or may be of a different type, for instance idling cylinders.

What is important is that the cylinders 30C and 30D operate in a similar manner as cylinders 30A and 30B to insulate the inside of the case 100 from air currents circulating around the apparatus 1. In this respect, as shown in FIG. 7, the cylinder 30C, arranged upstream of the deposition area 33 and above the belt 28, is provided with a front seal 100C acting on its external surface and two side seals 31C, each acting on one of the cylinder base. The counter-cylinder 30D is arranged opposed to the cylinder 30C and below the belt 28, and is provided with side seals 31D. The second couple of cylinders 30C, 30D configures as the inlet for the belt 28 entering the containment case 100.

Figure 7B:
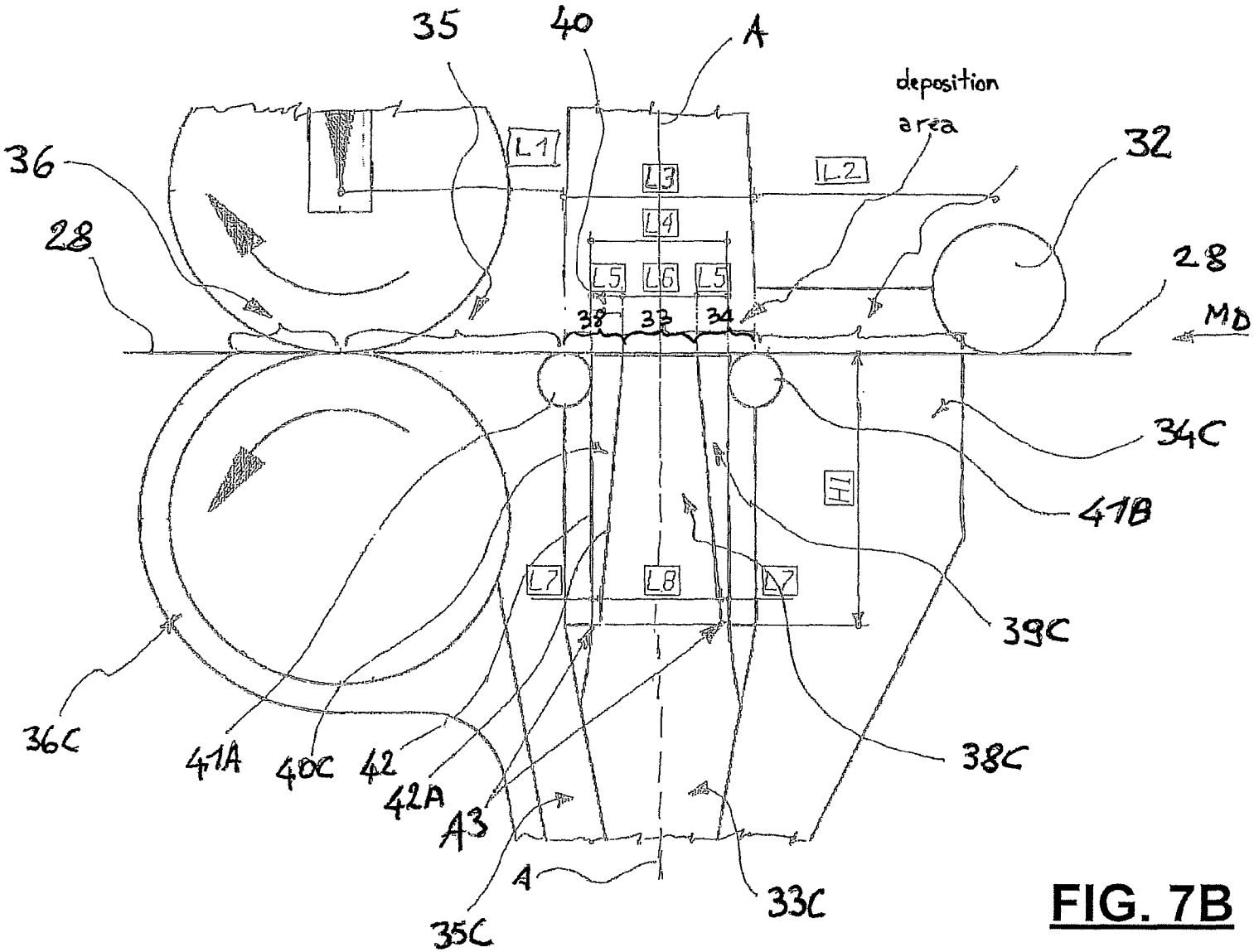
FIG. 7B is a magnified view of an alternative embodiment of the area of deposition of the filaments in the apparatus according to the invention.
Figure 7C:
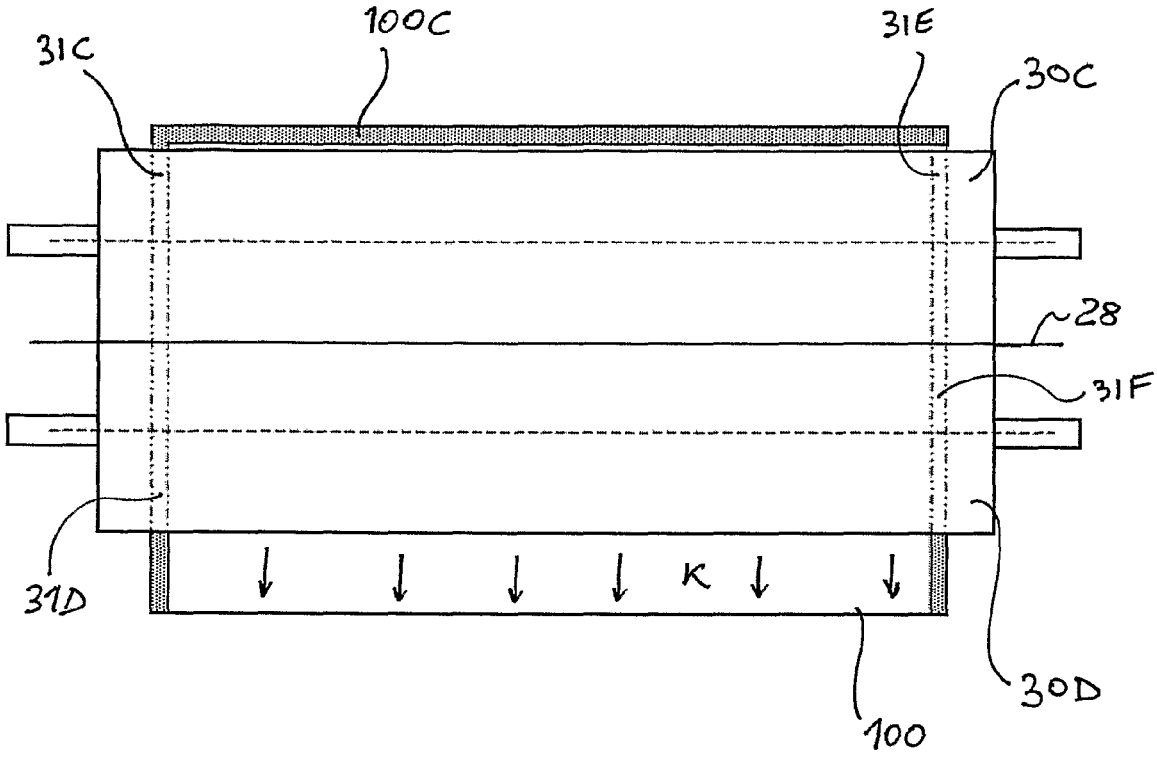
FIG. 7C is a section view along line X-X of FIG. 7.

With reference to FIG. 7C, which shows a partial section view along line X-X of FIG. 7, seal 100C is positioned above cylinder 30C. Seal 100C can be spaced few millimeters apart from the cylinder surface or can be in abutment with the same surface. For instance, if seal 100C is made of a metal stripe covered with felt, the felt can slide over the surface of the rotating cylinder 30C.

In FIG. 7C are also shown left side seals 31C and 31D and the correspondent right side seals 31E and 31F. Preferably these seals comprise felt stripes positioned in abutment with the cylinder surface.

As shown in FIG. 7B, alternatively to the second couple of pressing cylinders 30C and 30D, the apparatus can be provided with a small diameter idling cylinder 32 made of an auto-lubricating material, located at the entry of the case 100 with the function of closing the same and sealing the area of filament deposition and formation of the layer of non-woven fabric. The idler cylinder 32 is held in position against the belt 28 by the existing low pressure and prevents external air from entering the low pressure chamber.

As shown in FIG. 7, there are two areas 101 and 102 wherein sufficient sealing is guaranteed by the belt 28 sliding over the rounded edge of the wall of the case 100. Adhering of the belt 28 to the case 100 wall, while the same belt is moving along direction MD, is automatically achieved by virtue of the depression field generated inside the case 100 by the aspiration ducts. Such depression field keeps the belt 28 lowered. A non-significant quantity of air enters the case 100 by trespassing the belt 28 in 101 and 102, sucked by depression in the deposition area 33, but this air inflow may be minimized by shaping the case walls in 101 and 102 with strict tolerances. In any case the air is "filtered" by the belt 28 and does not affect the velocity field in the deposition area 33, nor brings new turbulence, in that is immediately removed from below the belt by the aspiration ducts, as it will be explained later on.

According to the present invention (as shown in FIGS. 6 and 7) the area of formation of the non-woven fabric extends from the idling cylinder 30C to the pair of cylinders 30A and 30B, and is in fluid connection with the source of low pressure, i.e. the aspirator 29, through a plurality of ducts A, B, C, D, E, F, G, H, K, having different extent and section to operate with different aspiration speeds and to define different aspiration areas 33-41. The ducts A-K are all arranged inside the containment case 100 to convey the air sucked from the respective belt length into the aspirator 29.

According to the present invention, the area of formation of the non-woven fabric that extends over the conveyor and collector belt 28 is connected to the source of low pressure area (or to the aspirator 29) by one or more aspiration ducts and each of the aspiration ducts is divided in turn into a plurality of sub-channels to provide a uniform aspiration speed over the entire mouth of the respective duct.

The belt 28 subjected to aspiration, comprises a central area of aspiration and deposition 33, two areas 34 and 38 lateral to this, respectively upstream and downstream of the chamber 33, two areas 35 and 39, respectively upstream and downstream of the areas 34 and 38, and two areas 36 and 40, respectively upstream and downstream of the areas 35 and 39. Upstream of the cylinders 30C and 30D there is the aspiration area 37 and downstream of the calender cylinders 30A and 30B there is the aspiration area 41.

With particular reference to FIG. 7, aspiration area 33 is sucked by duct A through the gas permeable belt 28, the aspiration area 34 is sucked by duct F, aspiration area 35 is sucked by duct G, aspiration area 36 is sucked by duct H, aspiration area 37 is sucked by duct K, aspiration area 38 is sucked by duct B, aspiration area 39 is sucked by duct C, aspiration area 40 is sucked by duct D, aspiration area 41 is sucked by duct E. The areas 33, 34 and 38 lie under the exit of channel 17B, the width of which is referred to as L3.

Since the high-speed air is drawn through the belt forming 28, this belt is pulled downward. To prevent this problem, two cylinders or two bars 41A and 41B are provided that support the belt 28.

In the embodiment shown in the FIGS. 1, 6 the aspiration ducts A-K are shown as separate and independently controlled ducts, i.e. each duct leads to a valve system of the aspirator 29.

Alternatively, some ducts may share the final channel leading to the aforesaid valve system. For instance, ducts A, B, C, F and G may open in the same initial channel as suggested in FIG. 7. This embodiments may provide mobile walls 42, 42A for adjusting the configuration (basically the section) of each duct as needed according to the circumstances. Moreover, by moving the mobile walls 42, 42A the filament deposition area 33+34+38 can be widened or reduced.

Preferably the low pressure areas 41 and 37, respectively located downstream of the calender formed by the pressing cylinders 30A and 30B and upstream of the cylinders 30C and 30D, have aspiration values 50% lower than the low pressure areas 39 and 35 located inside the containment case 100, between the cylinders and the nearest bar 41A. The flow values of areas 41 and 37 should therefore be balanced with the values of the flow aspirated in areas 39 and 35 respectively, preferably also calculating the values relating to air drawn by the conveyor belt, values that vary with the speed of the same.

For instance, in duct E speeds are included in the range 0.5-3 m/s, and in duct D speed is between 3.5 and 6 m/s.

With reference to FIGS. 6 and 7, L1 is the distance, measured on a horizontal plane, between the axis of the downstream roller 41A and the plane of the axes of the cylinders 30A and 30B; L3 is the distance (on said horizontal plane) between the upstream roller 41A and the downstream roller 41A, and L2 is the distance on said plane between the axis of the upstream roller 41A and the axis of the idling cylinders 30C and 30D.

With the aim of increasing the speeds of the airflows, the dimensions of the chambers of aspiration preferably respect the followings proportions: width L1 equal to the width L2, width L3 is about 75% of the width of L1 and L2.

With regard to the pressure to be achieved immediately under the belt 28, in each aspiration duct, this is the set of optimal values:

duct A→300 mbar;
duct B→250 mbar;
duct C→200 mbar;
duct D→150 mbar;
duct E→100 mbar;
duct F→180 mbar;
duct G→120 mbar;
duct H→80 mbar;
duct K→50 mbar.

The values of pressure measurable on the corresponding areas 33, 38, 39, 40, 41, 34, 35, 36 and 37 (respectively) may be the same or slightly different (interposition of the belt may cause local changes in the pressure).

The ducts A-K are connected to the aspirator 29 by means of flow regulators (respectively 44-47) that allow the values of low pressure area within the containment case 100 to be controlled, increasing or decreasing the aspiration speed of the air under the conveyor belt 28.

With reference to FIG. 7B, which shows an alternative embodiment of the apparatus of the present invention, the central area is divided into three aspiration areas, defined by corresponding aspiration ducts: a central duct 38C and two side ducts 39C and 40C, the side areas being preferably of equal width L5, while the central area has width L6. The side areas in low pressure defined by the ducts 39C and 40C are delimited by the supporting rollers or bars of 41A, 41B and by the walls 42 and 42A, that extend converging downward to the entrances 43. The walls 42A delimit the central area, which has a shape complementary to the two side areas, i.e. it widens from the top downwards.

The function of the side areas is to widen the deposit of the filaments from area 33 to an area 33+34+38, sufficiently wide to allow the disorganisation of the same. For this purpose, the structure indicated above allows aspiration speeds equal to 20 m/s (and generally between 12 and the 25 m/s inclusive) to be obtained in the ducts 39 and 40 and higher aspiration speeds in the in central low pressure area duct 38, for instance equal to 24 m/s (generally inclusive between 14 and the 35 m/sec) to achieve the maximum low pressure to get high filament speed. The speed values linked to the aspirator capacity are such to prevent the formation of waves in the non-woven fabric.

As shown in FIG. 7B, other geometric relationships exist that must be respected: the height H1 of the central duct 38C is three times the width L4; L6 is preferably double L5; L7 is preferably 9% of L8 and L6 is preferably 40% of L8.

In the embodiment of FIG. 7B, each of ducts 33C-36C is also divided by diaphragms 37 into a plurality of aspiration channels 49 separated by an interval from 50 to 150 mm and preferably of 100 mm. The diaphragms 37 begin immediately under the conveyor belt and extend to the group of the flow regulators. In a preferential embodiment, each of the aspiration channels 49 into which the ducts 33C-36C are divided is endowed with a rolling shutter or valve or other means of control and regulation of the airflow drawn into the channel. The duct 33C is divided into sub-conduits 38C-40C each of which is divided in turn by the diaphragms 37 into the channels 49. In other words, the channels indicated generically with the reference 49 will have different dimensions and form according to the related duct. With this arrangement, a uniform filament layer throughout the width of the belt, i.e. the deposition area.

FIG. 7A shows the scheme of the aspiration ducts which lie under the belt 28 (only the contour of the belt is shown, while the belt itself is in transparency). The low pressure chamber formed by the ducts A-K is composed of many small channels connected to at least one aspirator unit 29 so that to control in space and in time the low pressure value that doesn't have to have pulsations, oscillations or discontinuities. The area of aspiration is so divided in the longitudinal sense MD (Machine Direction) into one or more ducts A-K which are also divided in the transversal sense CD (Cross Direction) into a plurality of channels 49 preferably with quadrilateral section; in each of the channels the flow of the aspirated air is controlled and adjustable to give uniform aspiration over the whole width of the belt 28, i.e. the so-called Cross Direction of the machine. Therefore, a plurality of aspiration areas 33-41 will be located in succession in the longitudinal sense (MD), each with aspiration speed controlled and generally different from the others. Each of the areas 33-41 is transversally extended to the belt 28 and divided into a plurality of adjacent channels, in each of which the speed of aspiration is identical. In this way, the product obtained has a uniform density of deposition and therefore uniform physical and mechanical characteristics over its entire length and width. Advantageously, the apparatus and the method of the present invention provides for avoiding the environment airflows from negatively affecting the falling filaments path toward the deposition area by providing barrier means, i.e. the containment case or shell 100, which separates said depositing filaments from the external environment.

As mentioned above, the device of the invention enables very thin counts to be produced, e.g. up to 0.9 dtex for the mono-component filaments and up to 0.05-0.3 dtex for the bi-component and splittable side-by-side filaments. FIGS. 8-14 show structures of yarns obtainable with the method and the device according to the invention.

Figure 8:
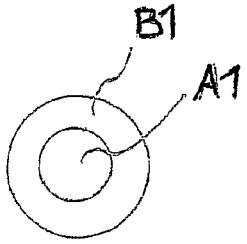
FIGS. 8 to 14 are views in section of fibers obtainable with the method and the device according to the present invention.
Figure 9:
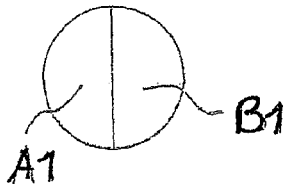
Figure 12:
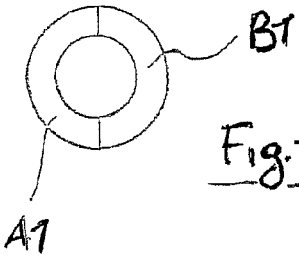

FIG. 8 shows a known yarn, comprising a core portion A1 and skin portion B1; in FIG. 9, the portions of polymer A1 and B1 are in the side-by-side arrangement, also already known, particularly for the "splittable" fibers, i.e. for those fibers that are divided after they have been collected on the belt 28 calendered and following "mechanical" treatment, e.g. with jets of water. FIG. 12 shows a "side-by-side" embodiment in which the central portion of the filament is absent.

Figure 10:
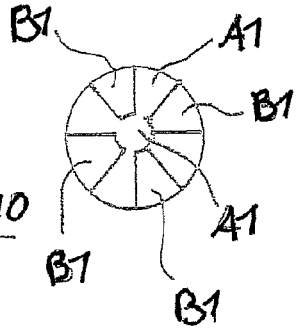
Figure 11:
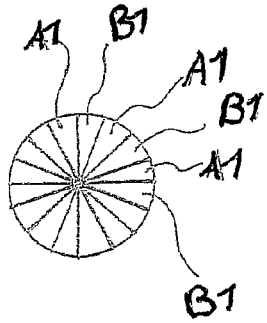
Figure 13:
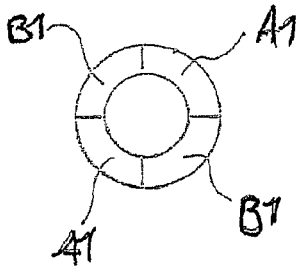
Figure 14:
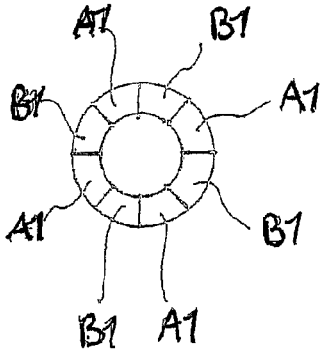

Other embodiments, not known until now, are shown in FIGS. 10 and 11 and in the corresponding hollow embodiments of FIGS. 13 and 14. In these embodiments, the yarn is composed of a plurality of adjacent portions radially located and alternating with each other, of polymer A1 and polymer B1. A central core can be present (FIG. 10) or absent (FIGS. 11, 13, 14). The yarns shown are obtained by spinnerets of the type shown in the patents U.S. Pat. No. 6,168,409 and EP 0995822, modified with the addition of a suitable number of radial channels that connect the interior part of the flexible duct 138 (FIG. 15) with the surrounding duct 140 of the first spinneret 110. For instance, the polymer A1 in FIG. 10 is present in five peripheral portions and on a central one and therefore there will be five channels present in the flexible duct 138 connecting the interior of the same with the surrounding duct 140.

The above also applies, changing what needs to be changed, for the other embodiments shown; if a central core is not required, the lower nozzle 144 of the duct 138 is not present and the polymer A escapes from the flexible duct 138 through channels cut into the wall of the duct 138.

The polymers A1 and B1 are preferably of the incompatible type so as to have good subdivision of the yarn into so many smaller fibers during the phase of "splitting" of the yarn.

The invention claimed is:

1. An apparatus for the production of a non-woven fabric of filaments, comprising a spinneret (2) to extrude a plurality of filaments, a cooling chamber (3) to cool said filaments, a stretching duct (7) located below the cooling chamber to stretch said filaments and a means for collecting the stretched filaments, wherein said means for collecting comprises a gas permeable mobile support element (28), at least one aspirator (29) and a plurality of aspiration ducts (33C-36C), to define a plurality of corresponding aspiration areas (33-36) on the mobile support element (28) through which air is drawn by the at least one aspirator (29) while depositing the stretched filaments on the gas permeable mobile support element (28) in a deposition area (33, 34, 38) to form a layer of filaments as a non-woven fabric of filaments, characterized in that said collecting means is provided with pneumatic insulation means to avoid inflow of ambient air from entering the deposition area (33, 34, 38) on said mobile support element (28), and wherein said pneumatic insulation means comprises a containment case (100) encompassing at least part of said mobile support element (28), a first pair of pressing cylinders (30A, 30B) forming a calender through which said non-woven fabric deposited on the mobile support (28) is made to pass, comprising furthermore an area of aspiration (41) external to said cylinders (30A, 30B), said first pair of cylinders (30A, 30B) being partially lodged within said containment case (100) downstream of said deposition area (33, 34, 38), and wherein said gas permeable mobile support element comprises a belt (28) that exits the containment case (100) by passing between said first pair of cylinders (30A, 30B), and further comprising a second pair of cylinders (30C, 30D) partially lodged within said containment case (100) upstream of said deposition area (33, 34, 38), and wherein said belt (28) enters the containment case by passing between said second pair of cylinders (30C, 30D).

2. The apparatus according to claim 1, in which said deposition area comprises a central portion (38) and two side portions (39, 40) that are configured and arranged so that a speed of aspiration in the central portion is higher than that in the side portions.

3. The apparatus according to claim 1, wherein said containment case (100) is quasi air-tight.

4. The apparatus according to claim 3, wherein said containment case (110) is provided with seals (100B, 100C, 31A-31F) interposed between case walls and any of the cylinders (30A, 30B, 30C, 30D).

5. The apparatus according to claim 4, wherein said seals (100B, 100C, 31A-31F) are any one selected from the group consisting of metal stripes, shaped elements made of an anti-friction material, and elements comprising felt stripes that abut the external surface of said cylinders.

6. The apparatus according to claim 1, in which the stretching duct (7) comprises two Venturi-effect elements (14, 21), to increase the speed of the filaments, and a filament dispersion element (25).

7. The apparatus according to claim 6, further comprising means for blowing and aspirating (20) to clean an ionization/de-ionization chamber (18,19) for the filaments.

* * * * *